US006626600B1

(12) United States Patent
Brand et al.

(10) Patent No.: US 6,626,600 B1
(45) Date of Patent: Sep. 30, 2003

(54) WRITING INSTRUMENT

(75) Inventors: Douglas A. Brand, Easton, PA (US); George J. Nagle, Phillipsburg, NJ (US); Vito Niosi, Easton, PA (US); Francis G. Schiro, Doylestown, PA (US)

(73) Assignee: Binney & Smith Inc., Easton, PA (US)

( * ) Notice: Subject to any disclaimer, the term of this patent is extended or adjusted under 35 U.S.C. 154(b) by 0 days.

(21) Appl. No.: 09/660,626

(22) Filed: Sep. 13, 2000

(51) Int. Cl.[7] ..... B43K 5/00; B43K 23/08
(52) U.S. Cl. ..... 401/202; 401/243; 401/246
(58) Field of Search ..... 401/98, 202, 243, 401/246, 247

(56) References Cited

U.S. PATENT DOCUMENTS

| | | | | |
|---|---|---|---|---|
| 1,478,157 | A | 12/1923 | Wintersteen | |
| 1,850,086 | A | 3/1932 | Segal | |
| 2,102,044 | A | 12/1937 | Sypher | |
| 2,192,644 | A | 3/1940 | La May et al. | |
| 2,416,596 | A | 2/1947 | Rosenthal | 15/134 |
| 2,676,349 | A | 4/1954 | Vosburg | |
| 3,281,887 | A | 11/1966 | Raffe | 15/569 |
| 3,446,563 | A | 5/1969 | Burnham | 401/199 |
| 3,666,373 | A | 5/1972 | Reed | 401/247 |
| 4,380,403 | A | 4/1983 | Endres et al. | 401/213 |
| 4,389,132 | A | 6/1983 | Valadez | 401/195 |
| 4,469,464 | A | 9/1984 | Capezzuto | 401/183 |
| 4,558,966 | A | 12/1985 | Mikuteit | 401/213 |
| 4,859,104 | A | 8/1989 | Roeder et al. | 401/202 |
| 4,865,479 | A | 9/1989 | Doll | 401/17 |
| 4,924,773 | A | 5/1990 | Gwilliam | 401/202 X |
| 5,018,894 | A | 5/1991 | Goncalves | 401/202 |
| 5,051,015 | A | 9/1991 | Moeck | 401/202 |
| 5,197,616 | A | 3/1993 | Buono | |
| 5,222,823 | A | 6/1993 | Conforti | 401/202 |
| 5,284,273 | A | 2/1994 | Schreiber | |
| 5,336,011 | A | 8/1994 | Ferguson et al. | 401/247 |
| 5,451,114 | A | 9/1995 | Ishigaki | 401/202 |
| 5,678,941 | A | 10/1997 | Nakajima | 401/205 |
| 5,713,681 | A | 2/1998 | Venne et al. | 401/202 |
| 5,885,020 | A * | 3/1999 | Rossi | 401/198 |
| 5,904,433 | A | 5/1999 | Kay | 401/269 |
| 5,938,081 | A | 8/1999 | Foster et al. | 222/153.09 |
| 5,984,550 | A | 11/1999 | Chuang | 401/57 |
| 5,988,923 | A | 11/1999 | Arai | 401/262 |

FOREIGN PATENT DOCUMENTS

| | | |
|---|---|---|
| DE | 8907648.6 | 8/1989 |
| FR | 2480679 | 10/1981 |
| GB | 722899 | 2/1955 |

OTHER PUBLICATIONS

Photographs of ballpoint pen labeled "'S Move" and "Stablio" which was available to applicant in Jan. 2000.

* cited by examiner

*Primary Examiner*—Gregory Huson
*Assistant Examiner*—Kathleen J. Prunner
(74) *Attorney, Agent, or Firm*—Leydig, Voit & Mayer, Ltd.

(57) ABSTRACT

The writing instrument includes a cap and a barrel. The cap includes threads which engage the threads on the barrel. In addition, the cap includes protrusions which engage protrusions on the barrel. The threads are designed so that the cap will engage the stop surface in approximately one third of a revolution. When the protrusions move past each other, the user perceives a tactile and/or audible indication. This indication advises the user that the cap has been fully attached to the barrel. In addition, the cap includes ribs on the exterior surface to assist the user in grasping the cap and in rotating the cap.

37 Claims, 6 Drawing Sheets

WRITING INSTRUMENT

FIELD OF THE INVENTION

The present invention relates generally to writing instruments and, more particularly, a cap and a barrel for writing instruments.

BACKGROUND OF THE INVENTION

Writing instruments, such as, markers may include a cap in order to prevent the writing instrument from drying out when it is not in use. One such writing instrument is a marker. Markers may include a cap which snaps onto the top of the marker in order to prevent the nib from drying out.

One of the difficulties in using a cap which snaps onto the marker is that the user may not fully position the cap onto the marker. Therefore, the cap does not create a proper seal which will expose air to the marker and allow the marker to dry out.

The purpose of the present invention is to provide a cap that provides a better seal for the marker nib and also provides the user with a visual, audible and/or tactile indication that the cap has been properly positioned on the marker.

SUMMARY OF THE INVENTION

The writing instrument includes a cap and a barrel. The cap includes threads which engage the threads on the barrel. In addition, the cap includes protrusions which engage protrusions on the barrel. The threads are designed so that the cap will engage the stop surface in approximately one third of a revolution. When the protrusions move past each other, the user perceives a tactile and/or audible indication. This indication advises the user that the cap has been fully attached to the barrel. In addition, the cap includes ribs on the exterior surface to assist the user in grasping the cap and in rotating the cap.

The present invention will become more readily apparent upon reading the following detailed description of the embodiments and upon reference to the accompanying drawings.

While the present invention will be described and disclosed in connection with certain embodiments and procedures, the intent is not to limit the present invention to these embodiments and procedures.

DESCRIPTION OF THE EMBODIMENTS

Figure 1:
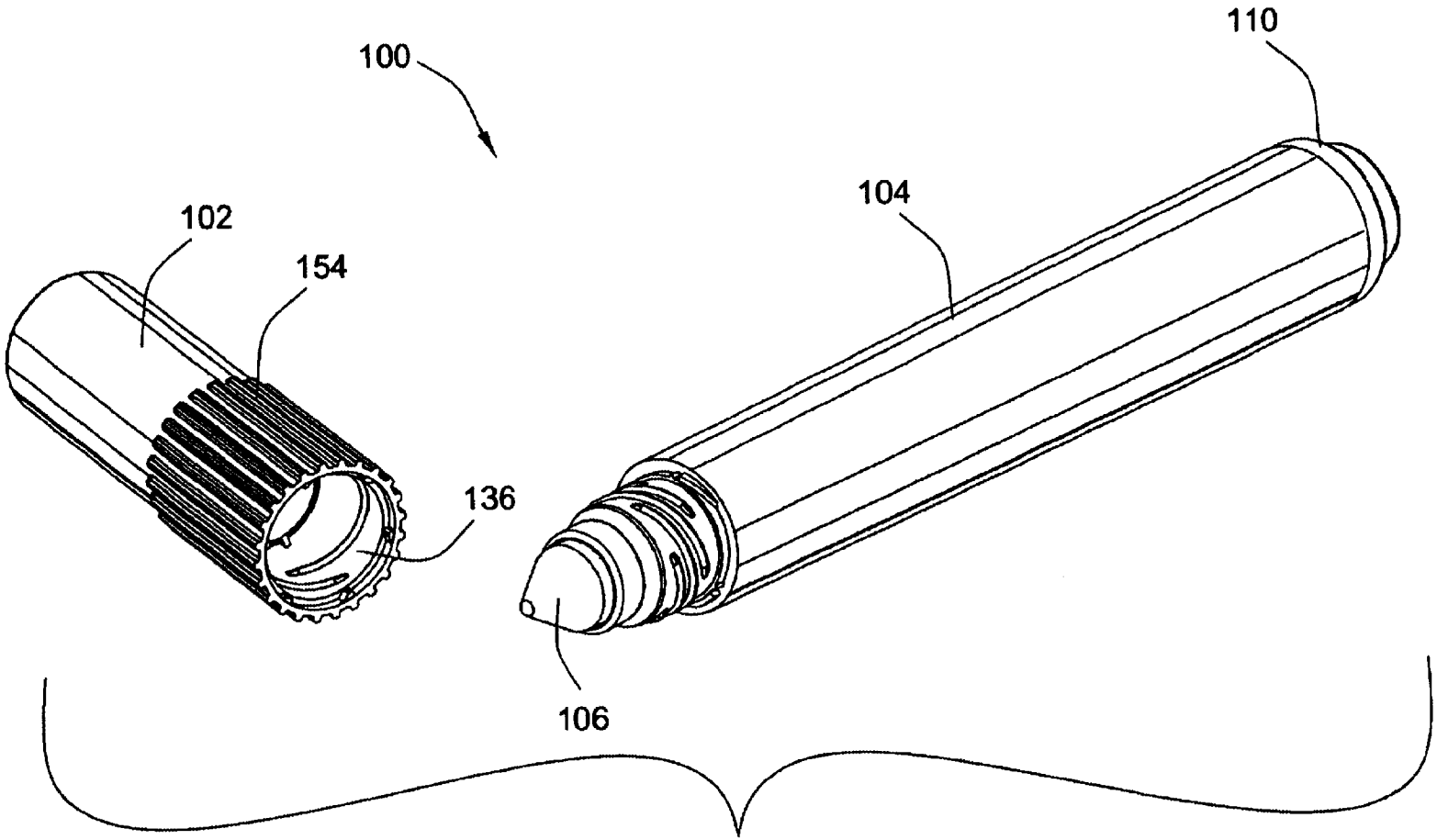
FIG. 1 is a perspective view of the cap and marker according to the present invention.
Figure 3:
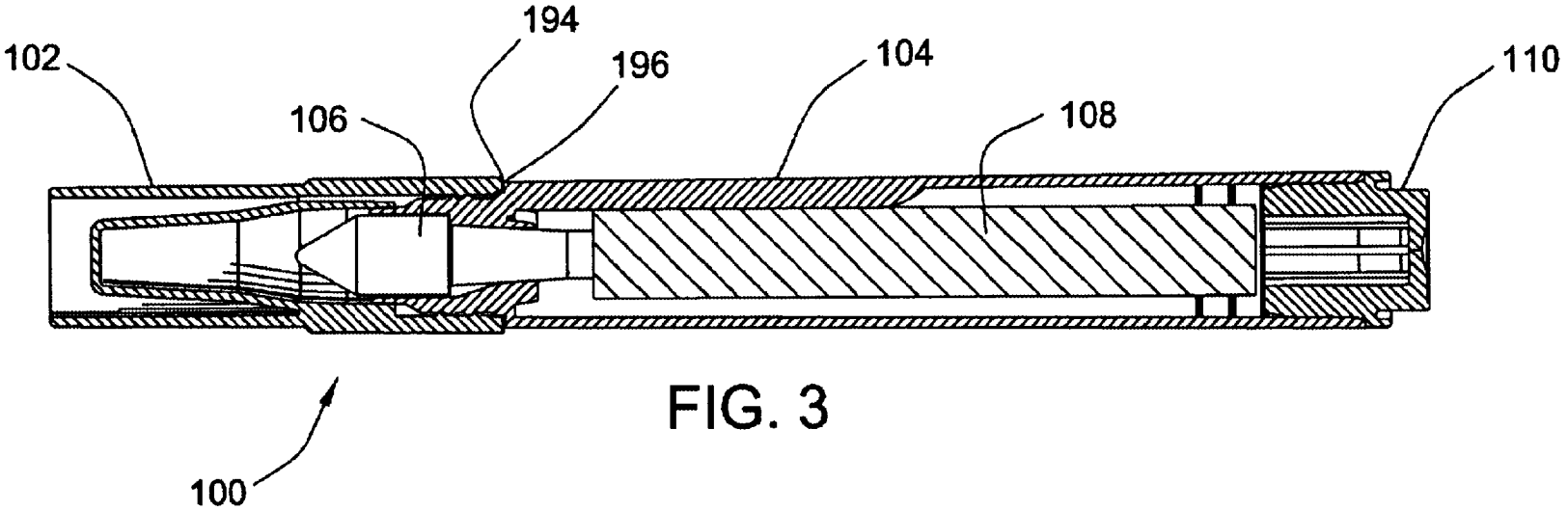
FIG. 3 is a cross-sectional view taken along line 3—3 in FIG. 2.
Figure 2:
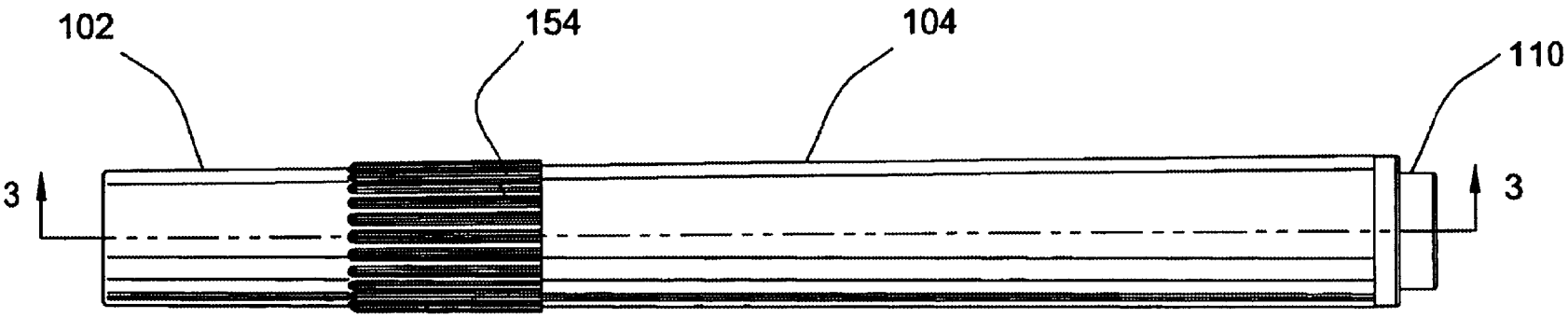
FIG. 2 is a side view of the marker in FIG. 1.

FIGS. 1–3 illustrate an embodiment of a writing instrument 100. The writing instrument may be a marker, a pen or other writing instrument. In this embodiment, the marker 100 may include a cap 102, a barrel 104, a nib 106, a reservoir 108 and an end plug 110. The cap 102 includes threads 120 which engage the threads 122 on the barrel 104. In addition, the cap includes protrusions 130 which engage protrusions 132 on the barrel 104.

The reservoir 108 includes ink which is transmitted to the nib 106 through capillary action. The reservoir 108 may be made of polyester, acetate or polypropylene fibers. The nib 106 may be made of bonded polyester or nylon fibers or may be made of sintered ultra high molecular weight polyethylene. The end plug 110 seals one end of the barrel 104. The cap 102 seals the other end of the barrel 104 and the nib 106.

In another embodiment, the marker may be a "free ink" system. In a free ink system, the marker may include a cap, a barrel, a nib and ink. However, the marker in a free ink system does not include a reservoir. The ink is transmitted to the nib when the user holds the marker in an upright position.

Figure 4:
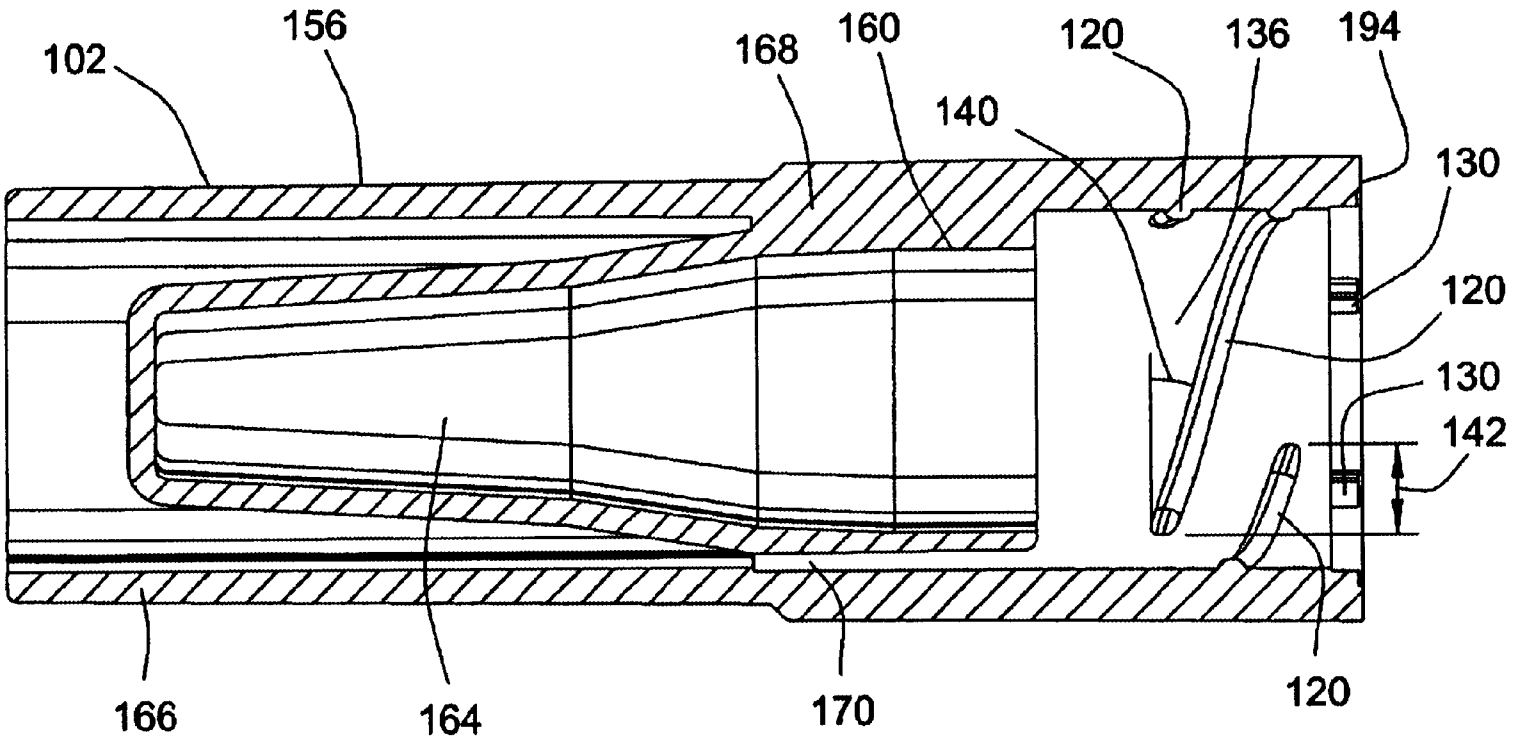
FIG. 4 is a cross-sectional view of the cap.

Referring to FIGS. 1 and 4, the cap 102 includes three threads 120. In other embodiments, the cap may include two, four or more threads. The threads 120 are located on the interior surface 136 of the cap 102. The interior surface can have a first circumference. Each thread 120 extends from beginning to end for approximately one-half the circumference of the interior surface 136 of the cap to define a thread length. For example, if the thread 120 began at 0 degrees, then the thread would stop at approximately 135 degrees. In addition, the threads are at an angle 140 of approximately 40 degrees along the interior surface 135 as shown in FIG. 4. The thread 120 has a pitch of 0.40, a revolution of 0.375 and a height of 0.15 inches. Each thread 120 overlaps with the adjacent thread a distance 142.

Figure 5:
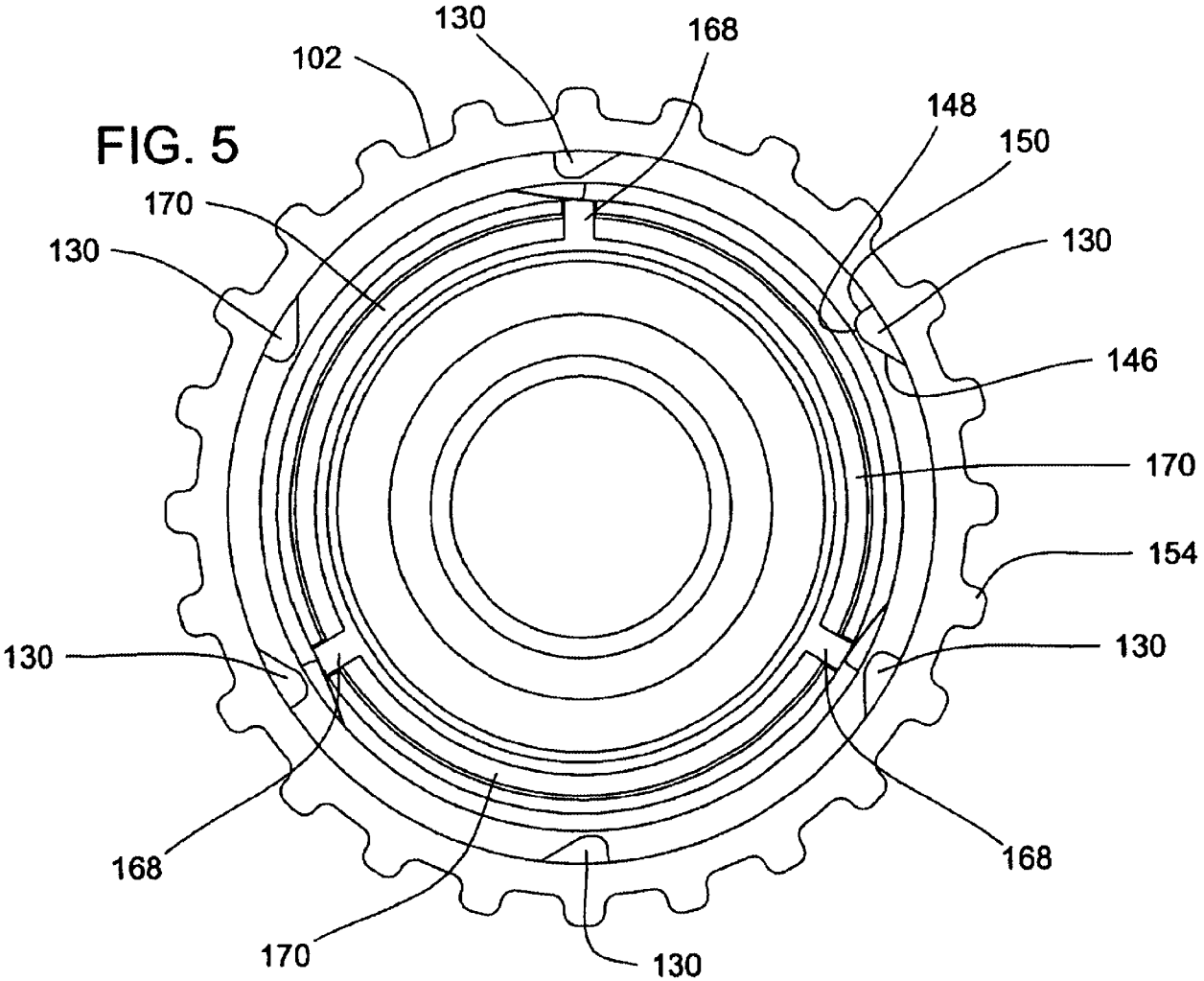
FIG. 5 is an end view of the cap.

In addition, the cap 102 includes six protrusions 130 which are located on the interior surface 136 of the cap as shown in FIGS. 4 and 5. In this embodiment the protrusions 130 are equally spaced around the interior surface 136. In other embodiments the cap could include one, two, three, four, five, seven or more protrusions. In addition, in other embodiments the protrusions could be equally or unequally spaced on the cap 102.

In this embodiment, the protrusions 130 include a ramp surface 146, a horizontal surface 148 and a vertical surface 150. In other embodiments, the protrusions may have other shapes and surfaces.

Referring to FIGS. 1 and 5, the cap 102 may include ribs 154 on the exterior surface 156 to assist the user in grasping the cap and in rotating the cap. In this embodiment, the cap has twenty four ribs 154 which are equally spaced around the exterior surface. In other embodiments, the cap may include more or less ribs which may be equally or unequally spaced.

Referring to FIG. 4, the cap 102 includes a sealing surface 160 on the interior of the cap. The sealing surface 160 on the cap engages the sealing surface on the barrel as will be described below. In addition, the cap 102 is a ventilated cap which permits air to flow between the interior surface 136 and the exterior surface 156. The cap may be an internally ventilated cap or the cap may be an externally ventilated cap. In one embodiment of an internally ventilated cap, the cap 102 has an inner cap 164 and an outer cap 166 which are connected by webs 168 as shown in FIGS. 4 and 5. The webs 168 are separated by air spaces 170 which allow air to flow between the webs. Thus, air can flow between the inner cap 164 and the outer cap 166 if the cap became lodged in the throat of the user. In one embodiment of an externally ventilated cap, the cap includes a series of ribs on the exterior surface which permits air to flow between the ribs.

Figure 6:
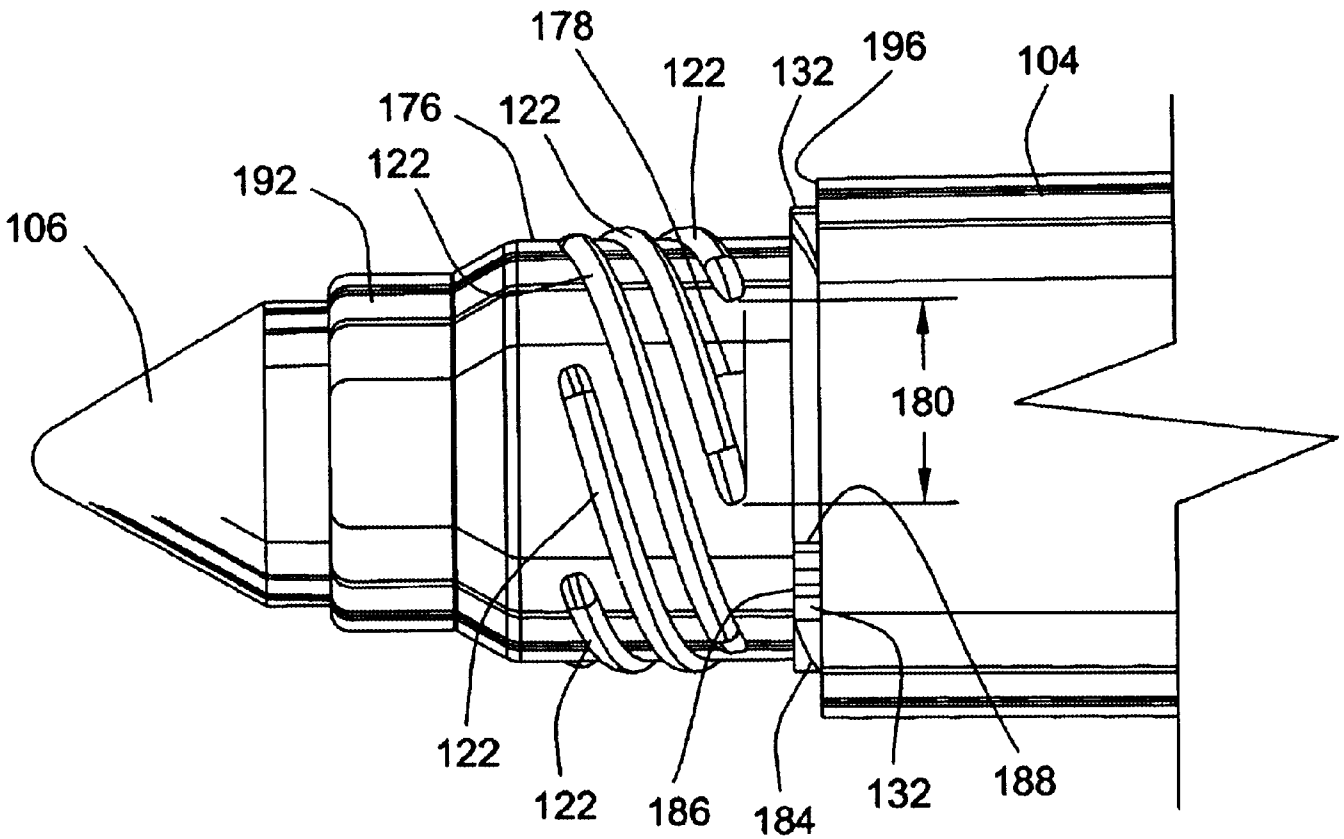
FIG. 6 is a partial side view of the barrel and marker nib.

Referring to FIGS. 1 and 6, the barrel 104 includes six threads 122. In other embodiments the barrel could include one, two, three, four, five, seven or more threads. The barrel 104 has a first end and a second end. The first end has the threads 122. The threads are located on the exterior surface 176 of the barrel. The exterior surface can have a second circumference. Each thread extends from the beginning to the end for approximately one-half the circumference of the exterior surface 176 thereby defining a thread length. For example, if the thread 122 began at 0 degrees, then the thread 122 would stop at approximately 135 degrees. In addition, the threads 122 are at angle 178 of approximately 40 degrees along the exterior surface as shown in FIG. 6. The thread 122 has a pitch of 0.40, a revolution of 0.375 and a height of 0.15 inches. Each thread overlaps with the adjacent thread a distance 180.

Figure 7:
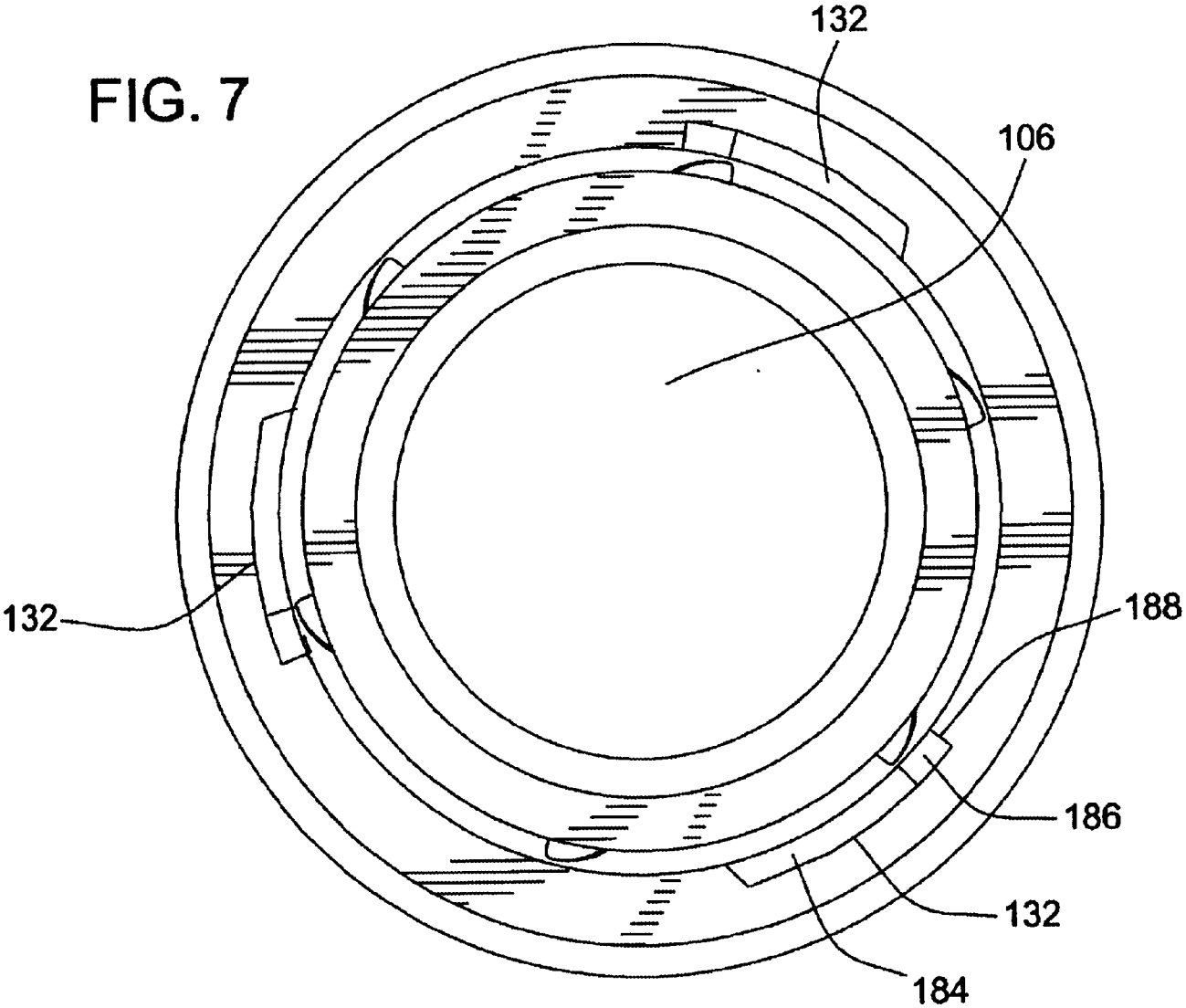
FIG. 7 is an end view of the barrel and marker nib.

Referring to FIGS. 6 and 7, the barrel 104 includes three protrusions 132 which are located on the exterior of the barrel and below the threads. In this embodiment, the protrusions 132 are equally spaced around the exterior. In other embodiments, the protrusions may be unequally spaced on the barrel. In addition, in other embodiments, the barrel may include one, two, four or more protrusions.

In this embodiment, the protrusions 132 include a ramp surface 184, a horizontal surface 186 and a vertical surface 188. In other embodiments, the protrusions may have other shapes and surfaces.

The barrel 104 includes a sealing surface 192. The sealing surface 192 engages the sealing surface 160 on the cap as will be described below.

The cap 102 is attached to the barrel 104 to seal the end of the barrel in order to prevent the nib 106 from drying out. The cap is attached to the barrel in the following manner. The user grasps the cap and positions the cap on the barrel. The user then rotates the cap relative to the barrel. The threads 120, 122 engage and cause the cap to move closer to the barrel. The threads 120, 122 are designed so that the threads will engage in less than one eighth of a revolution. The user continues to rotate the cap relative to the barrel until the bottom surface 194 of the cap engages the stop surface 196 on the barrel as shown in FIG. 3. In this embodiment, the threads are designed so that the cap 102 will engage the stop surface 196 in approximately one third of a revolution.

In other embodiments, the threads may be designed so that the cap engages the stop surface in approximately one fourth of a revolution, one half of a revolution, three fourths of a revolution, one revolution or more.

As the cap 102 is moving closer to the barrel 104, the sealing surface 160 on the cap engages the sealing surface 192 on the barrel as shown in FIG. 3. The sealing surfaces slide over each other and create a seal at the end of the barrel which prevents the nib from drying out.

In addition, in this embodiment, the cap 102 and the barrel 104 include protrusions. As the cap approaches the stop surface, the protrusions 130 engage the protrusions 132. The protrusion 130 proceeds up the ramp surface 184, along the horizontal surface 186 and past the vertical surface 188. When the protrusions 130, 132 move past each other, the user perceives a tactile and/or audible indication. This indication advises the user that the cap has been fully attached to the barrel. In addition, the user has a visual indication because the bottom surface 194 of the cap engages the stop surface 196 of the barrel.

The ribs 154 assist the user in rotating the cap 102 by providing a gripping surface so that the fingers and thumb of the user are less likely to slip.

By threading the cap onto the barrel, the user feels that a better seal has been achieved in comparison to a cap which does not thread onto the barrel. Furthermore, the rotating or twisting motion to remove the cap is a more natural motion than a pulling motion.

The cap 102 is removable from the barrel 104 so that the user may use the marker 100 to write on various objects. In order to remove the cap 102, the user rotates the cap 102 relative to the barrel 104. The protrusions move past each other and the threads 120, 122 cause the cap to rotate away from the barrel 104. The threads are designed so that the cap will disengage the barrel in approximately one third of a revolution.

The cap may be made from plastic, such as, a polypropylene copolymer, polypropylene homopolymer, polyethylene or polystyrene. The barrel and end cap may be made from plastic, such as, a polypropylene copolymer, polypropylene homopolymer, polyethylene or polystyrene.

From the foregoing it will be understood that modifications and variations may be effectuated to the disclosed structures—particularly in light of the foregoing teachings—without departing from the scope or spirit of the present invention. As such, no limitation with respect to the specific embodiments described and illustrated herein is intended or should be inferred. In addition, all references and co-pending applications cited herein are hereby incorporated by reference in the entireties.

What is claimed is:

1. A marker for marking on objects comprising:

a cap, the cap has an exterior surface, and an interior surface, the interior surface has a first thread, a barrel, the barrel has a first end and a second end, the first end includes a second thread, the first thread engages the second thread when the cap is positioned on the barrel, the first thread has a length, the interior surface has a first circumference, the second thread has a length, the barrel has an exterior surface having a second circumference, a nib, the nib selected from the group comprising polyester fibers, nylon fibers, or sintered ultra high molecular weight polyethylene, ink, and the cap is ventilated, the cap is attached to the barrel to seal the end of the barrel to prevent the nib from drying out the cap is removable from the barrel, the cap permits air flow if the cap became lodged in the throat of the user.

2. The invention as in claim 1 wherein the interior surface has a third thread.

3. The invention as in claim 1 wherein the first end includes a fourth thread.

4. The invention as in claim 1 wherein the interior surface has two threads and the second end has two threads.

5. The invention as in claim 1 wherein the interior surface has one protrusion.

6. The invention as in claim 1 wherein the first end has a protrusion below the second thread.

7. The invention as in claim 1 wherein the interior surface has one protrusion and the first end has a protrusion below the second thread.

8. The invention as in claim 1 wherein the exterior surface of the cap has a rib.

9. The invention as in claim 1 wherein the exterior surface of the cap has two ribs.

10. The invention as in claim 1 wherein the interior surface has a circular cross-section.

11. The invention as in claim 1 further comprising a reservoir.

12. The invention as in claim 1 further comprising an end plug.

13. The invention as in claim 1 wherein the cap permits air flow between the interior surface and the exterior surface.

14. The invention as in claim 13 wherein the cap is an internally ventilated cap.

15. The invention as in claim 1, wherein the cap has a bottom surface, the barrel has a stop surface, and the cap engages the stop surface.

16. The invention as in claim 15 wherein the cap engages the stop surface in approximately one-fourth of a revolution.

17. The invention as in claim 15 wherein the cap engages the stop surface in approximately one-third of a revolution.

18. The invention as in claim 15 wherein the cap engages the stop surface in approximately one-half of a revolution.

19. The invention as in claim 15 wherein the cap engages the stop surface in approximately three-fourths of a revolution.

20. The invention as in claim 15 wherein the cap engages the stop surface in approximately one revolution.

21. The invention as in claim 1, wherein the interior surface has a first protrusion and the first end has a second protrusion, the first protrusion engages the second protrusion when the cap is threaded on the barrel to provide an indication that the cap is fully threaded onto the barrel.

22. The writing instrument of claim 21 wherein the provided indication is a tactile indication.

23. The writing instrument of claim 21 wherein the provided indication is an audible indication.

24. The invention as in claim 1, wherein the first thread extends for approximately one-half the circumference of the interior surface.

25. A cap for a marker, the marker having a barrel and a nib, the cap comprising:

an exterior surface;

an interior surface;

a sealing surface to create a seal at the end of the barrel to prevent the nib from drying out;

a thread on the interior surface the thread has a length, the interior surface has a circumference; and the cap is ventilated, the cap permits airflow if the cap became lodged in the throat of the user.

26. The invention as in claim 25 wherein the interior surface has a second thread.

27. The invention as in claim 26 wherein the interior surface has a third thread.

28. The invention as in claim 25 wherein the interior surface has a protrusion.

29. The invention as in claim 25 wherein the interior surface has two protrusions.

30. The invention as in claim 25 wherein the interior surface has six protrusions.

31. The invention as in claim 25 wherein the exterior surface has a rib.

32. The invention as in claim 25 wherein the exterior surface has two ribs.

33. The invention as in claim 25 wherein the interior surface of the cap has a circular cross-section.

34. The invention as in claim 25 wherein the cap has a first end and a second end, the thread is positioned at an angle from the first end to the second end.

35. The invention as in claim 34 wherein the angle is 40 degrees.

36. The invention as in claim 25 wherein the cap permits air to flow between the interior surface and the exterior surface.

37. The invention as in claim 36 wherein the cap is an internally ventilated cap.

* * * * *

UNITED STATES PATENT AND TRADEMARK OFFICE

CERTIFICATE OF CORRECTION

PATENT NO. : 6,626,600 B1
APPLICATION NO. : 09/660626
DATED : September 30, 2003
INVENTOR(S) : Brand et al.

It is certified that error appears in the above-identified patent and that said Letters Patent is hereby corrected as shown below:

Column 4, lines 53-54 (claim 4) "the interior surface has two threads and the second thread has two threads." should read --the interior surface has a third thread and the first end has a fourth thread.--

Signed and Sealed this

Fifteenth Day of January, 2008

JON W. DUDAS
*Director of the United States Patent and Trademark Office*